US011052562B2

(12) United States Patent
Béguin et al.

(10) Patent No.: US 11,052,562 B2
(45) Date of Patent: Jul. 6, 2021

(54) TOOL-HOLDER COLUMN, UNIT FOR CONVERTING A FLAT SUBSTRATE, AND METHODS FOR REMOVING A ROTARY TOOL FROM AND MOUNTING IT IN A CONVERSION UNIT

(71) Applicant: BOBST MEX SA, Mex (CH)

(72) Inventors: Boris Béguin, Féchy (CH); Philippe Clément, Penthalaz (CH)

(73) Assignee: BOBST MEX SA

( * ) Notice: Subject to any disclaimer, the term of this patent is extended or adjusted under 35 U.S.C. 154(b) by 425 days.

(21) Appl. No.: 15/532,129

(22) PCT Filed: Nov. 20, 2015

(86) PCT No.: PCT/EP2015/025087

§ 371 (c)(1),
(2) Date: Jun. 1, 2017

(87) PCT Pub. No.: WO2016/087048

PCT Pub. Date: Jun. 9, 2016

(65) Prior Publication Data

US 2017/0266833 A1 Sep. 21, 2017

(30) Foreign Application Priority Data

Dec. 4, 2014 (EP) ..... 14020100

(51) Int. Cl.
*B26D 7/26* (2006.01)
*B31F 1/07* (2006.01)
(Continued)

(52) U.S. Cl.
CPC ..... *B26D 7/265* (2013.01); *B31B 50/14* (2017.08); *B31B 50/25* (2017.08); *B31F 1/07* (2013.01);
(Continued)

(58) Field of Classification Search
CPC .... B26D 7/265; B26D 7/2614; B26D 7/2621; B31F 2201/0753; B31F 1/10;
(Continued)

(56) References Cited

U.S. PATENT DOCUMENTS 2,706,524 A * 4/1955 Hall ..... B23D 35/007 83/481
4,413,541 A * 11/1983 Biggar, III ..... B23D 35/008 101/153
(Continued)

FOREIGN PATENT DOCUMENTS

EP 0 287 848 A1 10/1988
EP 1 537 920 A1 6/2005
(Continued)

OTHER PUBLICATIONS

International Search Report dated Feb. 18, 2016 in corresponding PCT International Application No. PCT/EP2015/025087.
(Continued)

*Primary Examiner* — Thanh K Truong
*Assistant Examiner* — Katie L Gerth
(74) *Attorney, Agent, or Firm* — Ostrolenk Faber LLP

(57) ABSTRACT

A tool-holder column for a unit for converting a flat substrate that has two upper bearings (14, 16) each for supporting one end of an upper rotary tool (10), and two lower bearings (15, 17) each for supporting one end of a lower rotary tool (11), the flat substrate being movable longitudinally between the upper rotary tool (10) and the lower rotary tool (11), the bearings (14, 15, 16, 17) being vertically movable in opposite directions on either side of the longitudinal direction (L) of movement of the flat substrate, and a common drive for the bearings (14, 15, 16, 17) allowing the bearings (14, 15, 16, 17) to be moved simultaneously by one and the same distance in opposite directions, and including a screw device
(Continued)

(25), the bearings (14, 15, 16, 17) being mounted one above another on the screw device (25) such that the rotation of the screw device (25) causes the linear movement of the bearings (14, 15, 16, 17) in opposite directions.

12 Claims, 8 Drawing Sheets

(51) Int. Cl.
*B31F 1/10* (2006.01)
*B31B 50/25* (2017.01)
*B31B 50/14* (2017.01)
*B31B 50/88* (2017.01)
*B31B 100/00* (2017.01)

(52) U.S. Cl.
CPC ..... *B31F 1/10* (2013.01); *B31B 50/146* (2017.08); *B31B 50/256* (2017.08); *B31B 50/88* (2017.08); *B31B 2100/002* (2017.08); *B31F 2201/0753* (2013.01); *B31F 2201/0776* (2013.01)

(58) Field of Classification Search
CPC ..... B31F 50/256; B31F 50/146; B31F 1/07; B31F 2201/0776; B31B 50/14; B31B 50/25; B31B 50/88; B31B 2100/002
USPC ..... 83/344
See application file for complete search history.

(56) References Cited

U.S. PATENT DOCUMENTS 4,732,082 A 3/1988 Ireton ..... 101/23
4,911,047 A * 3/1990 Hornung ..... B26D 1/626 83/284
4,922,779 A * 5/1990 Fritz ..... B23D 35/008 83/503
5,048,387 A * 9/1991 Niitsuma ..... B41F 13/62 83/344
5,388,490 A * 2/1995 Buck ..... B26D 7/2628 83/344
5,467,678 A * 11/1995 Stollenwerk ..... B26D 7/2628 100/170
5,598,758 A * 2/1997 Chmelar ..... B23D 35/008 83/100
6,085,626 A * 7/2000 Pfaff, Jr. ..... B26D 7/2628 83/698.51
8,356,536 B2 * 1/2013 Madern ..... B23D 35/008 83/343
2005/0103173 A1 * 5/2005 Elkis ..... B23D 35/008 83/343
2005/0119099 A1 * 6/2005 Madern ..... B21B 31/02 493/144
2007/0243278 A1 * 10/2007 Anelli ..... B31F 1/07 425/365
2012/0216662 A1 * 8/2012 Yamada ..... B26F 1/384 83/331

FOREIGN PATENT DOCUMENTS

WO WO 2005/123374 A1 12/2005
WO WO 2014/135265 A1 9/2014

OTHER PUBLICATIONS

Written Opinion dated Feb. 18, 2016 in corresponding PCT International Application No. PCT/EP2015/025087.

* cited by examiner

TOOL-HOLDER COLUMN, UNIT FOR CONVERTING A FLAT SUBSTRATE, AND METHODS FOR REMOVING A ROTARY TOOL FROM AND MOUNTING IT IN A CONVERSION UNIT

CROSS-REFERENCE TO RELATED APPLICATION

The present application is a 35 U.S.C. §§ 371 national phase conversion of PCT/EP2015/025087, filed Nov. 20, 2015, which claims priority of European Patent Application No. 14020100.5, filed Dec. 4, 2014, the contents of all of which are incorporated herein by reference. The PCT International Application was published in the French language.

FIELD OF THE INVENTION

The present invention relates to a tool-holder column for a unit for converting a flat substrate. The invention relates to a unit for converting a flat substrate. The invention also relates to a method for removing at least one rotary tool from and mounting it in a conversion unit.

BACKGROUND

A machine for converting a substrate is intended for the production of packaging. In this machine, an initial flat substrate, such as a continuous web of cardboard, is unrolled and printed on by a printing station comprising one or more printer units. The flat substrate is then transferred into an introduction unit and then into an embossing unit, possibly followed by a scoring unit. The flat substrate is then cut in a cutting unit. After ejection of the scrap areas, the preforms obtained are sectioned in order to obtain individual boxes.

The rotary conversion, i.e. embossing, scoring, cutting, scrap-ejection, or printer units each comprise a cylindrical upper conversion tool and a cylindrical lower conversion tool, between which the flat substrate passes in order to be converted. In operation, the rotary conversion tools rotate at the same speed but in opposite directions to one another. The flat substrate passes through the gap situated between the rotary tools, which form a relief by embossing, form a relief by scoring, cut the flat substrate into preforms by rotary cutting, eject the scrap, or print a pattern during printing.

The cylinder changing operations have been found to be time-consuming and tedious. The operator must mechanically disconnect the cylinder in order to remove the cylinder from its drive mechanism. Then, the operator must extract the cylinder from the conversion machine and fit the new cylinder in the conversion machine by reconnecting the cylinder to its drive. The weight of a cylinder is high, around 50 kg to 2000 kg. In order to extract the cylinder, the operator must lift the cylinder with the aid of a hoist.

Because of its fairly high weight, a cylinder cannot be changed very quickly. Moreover, numerous tool changes may be necessary to obtain a very large number of boxes that are different from one another. These tools have to be ordered a long time in advance, which is becoming incompatible with the production changes that are currently required. In addition, tools are relatively expensive to produce and they only become cost-effective with an extremely large output.

Therefore, some conversion units provide for the use of rotary tools made up of a mandrel and a removable sleeve carrying the form for carrying out the conversion that is able to be fitted on the mandrel. All that is necessary is to change the sleeve rather than the entire rotary tool. This makes it easier to change the tool because of the low weight of the sleeve and reduces costs since the sleeve is less expensive.

Users wish to effect more rapid tool changes in order to deal with the increasingly specific requirements made by their customers of printing and cutting small runs. Moreover, the rotary tools have to be able to be held with good rigidity and with precision for the conversion operations to be carried out properly.

SUMMARY OF THE INVENTION

An aim of the present invention is to propose a tool-holder column for a unit for converting a flat substrate, a conversion unit, a method for removing a rotary tool and a mounting method which at least partially solve the drawbacks of the prior art.

To this end, a subject of the present invention is a tool-holder column for a unit for converting a flat substrate, comprising:

- two upper bearings each intended to support one end of an upper rotary tool, and two lower bearings each intended to support one end of a lower rotary tool, the flat substrate being intended to move longitudinally between the upper rotary tool and the lower rotary tool, the upper and lower bearings being vertically movable in opposite directions on either side of the longitudinal direction of movement of the flat substrate, and
- a common drive for the upper and lower bearings, allowing the upper and lower bearings to be moved simultaneously by one and the same distance in opposite directions, and comprising a screw device, the upper and lower bearings being mounted one above another on the screw device such that the rotation of the screw device causes a linear movement of the upper and lower bearings in opposite directions.

The vertical mobility of the two bearings makes it possible to adjust the spacing between the rotary tools notably in order to set the gap between the tools. The gap between the upper tool and the lower tool can be adjusted during production. Moreover, the adjustability of the gap makes it possible to move the rotary tools by way of drives that have effective setting precision of the movement and holding rigidity, which are significant constraints to be respected in order to carry out the conversion operations properly. The concordance of the cutting, embossing and scoring areas can thus notably be ensured. The operations of cutting, embossing or scoring are likewise produced with the same quality over the entire surface of the flat substrate.

According to one exemplary embodiment, the screw device comprises at least one screw that extends in the vertical direction and comprises an upper helix engaging with the bearing in which the upper bearing is provided and a lower helix engaging with the bearing in which the lower bearing is provided, the direction of the upper helix being opposite to the direction of the lower helix.

The screw device allows the two bearings to be raised and lowered simultaneously and at the same speed. Moreover, the use of screw devices allows heavy loads such as those of the rotary tools to be moved while affording effective setting precision of the movement and with good holding rigidity. Another advantage is that the screw devices are robust and can hold the vertical positioning of the bearings without deviation even under the effect of vibrations that can arise in the framework of the conversion unit.

According to one exemplary embodiment, the screw device comprises at least one roller screw. The large number of contact points allows the roller screws to support heavy loads while affording effective setting precision of the movement in translation. The diameter of the screw can thus be large in relation to the screw pitch which can be small, thereby making it possible to support heavy loads while having excellent setting precision of the movement, and thereby making it possible to ensure that the vertical movement of the bearings is irreversible.

According to one exemplary embodiment, the screw device comprises a first and a second screw that are arranged parallel to one another, on each side of the upper and lower bearings. The two screws ensure that the bearings are held in a balanced and reinforced manner. According to one exemplary embodiment, the screw device comprises a motorized device that is configured to drive the first and the second screw simultaneously in rotation.

According to one exemplary embodiment, the motorized device comprises a first and a second toothed belt for synchronous slip-free transmission. The first toothed belt is driven in rotation by a motor shaft of the motorized device and drives a first pulley mounted at the end of the first screw of the screw device in rotation. The second toothed belt is likewise driven in rotation by the motor shaft and drives a second pulley mounted at the end of the second screw of the screw device in rotation.

According to one exemplary embodiment, the bearings have substantially identical shapes, mounted facing one another. The bearings each have, for example, overall shapes that are elongate in the longitudinal direction of movement of the flat substrate. These embodiments of the bearings make it possible to concentrate the forces exerted on the tool-holder column at the bearings, ensuring good holding rigidity of the rotary tools.

According to one exemplary embodiment, the bearings and a body of the tool-holder column comprise complementary means for guiding in vertical translation. According to one exemplary embodiment, at least one bearing is movable out of a central passage, allowing the extraction or insertion of at least one rotary tool.

A further subject of the invention is a unit for converting a flat substrate, comprising at least one tool-holder column as described above. According to one exemplary embodiment, the conversion unit comprises a tool-holder column that is movable in translation in a direction parallel to the axis of the rotary tools between an operational position in which the upper and lower bearings can engage with ends of rotary tools and a maintenance position in which the tool-holder column is spaced apart from the operational position. The mobility of the tool-holder column makes it possible to disengage the ends of the rotary tools from their respective bearings such that the latter can then be offset vertically from one another so as to free up a central passage allowing access to the rotary tools. It also makes it possible to offset the bearings from one another in a maintenance phase, once the bearings on the operator's side have been disengaged from the rotary tools, so as to free up a central passage allowing access to the rotary tools.

The movable tool-holder column is for example the tool-holder column arranged at the front, on the operator's side, which is not obstructed by the motorized drive means of the rotary tools. According to one exemplary embodiment, the tool-holder column and a pedestal of the conversion unit comprise complementary means for guiding in translation. According to one exemplary embodiment, the conversion unit comprises a processing unit configured to independently control both the vertical movement of the bearings of a tool-holder column of the conversion unit arranged at the front, and the vertical movement of the bearings of a tool-holder column of the conversion unit arranged at the rear.

A further subject of the invention is a method for removing at least one rotary tool from a conversion unit as described and claimed below, comprising the following steps of:

- vertically moving the upper and lower bearings in opposite directions,
- offsetting the tool-holder column arranged at the front such that the upper and lower bearings are disengaged from the ends of the upper and lower rotary tools, and then
- moving the front upper and lower bearings of the tool-holder column arranged at the front vertically in opposite directions such that the bearings are positioned out of a central passage, allowing the extraction of the rotary tools.

A further subject of the invention is a method for mounting at least one rotary tool in a conversion unit as described and claimed below, comprising the following steps of:

- moving the front bearings of the tool-holder column arranged at the front vertically toward one another, and then
- offsetting the tool-holder column arranged at the front such that the ends of the rotary tools engage in the upper and lower bearings.

Thus, when changing a rotary tool, a sleeve or a mandrel is desired, the operator may start by spacing the upper and lower bearings slightly apart from one another in order to ensure that the rotary tools do not come into contact during the tool change. Next, the operator may disengage the ends of the rotary tools from their respective bearings by moving the tool-holder column arranged at the front in translation, such that said bearings can then be greatly offset vertically with respect to one another in order to free up a central passage allowing access to the rotary tools.

The upper and lower bearings that are vertically movable in opposite directions, on either side of the longitudinal direction of movement of the flat substrate, thus allow simple mounting/removal of the rotary tools while ensuring a rigid and precise hold of the rotary tools in operation.

BRIEF DESCRIPTION OF THE DRAWINGS

Further advantages and features will become apparent from reading the description of the invention and from the appended figures, which show a nonlimiting exemplary embodiment of the invention and in which.

Figure 2:
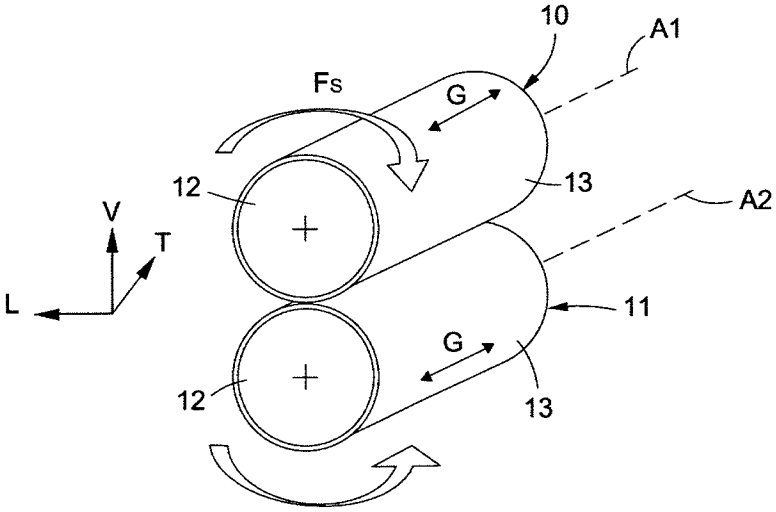
FIG. 2 shows a perspective view of an upper rotary tool and of a lower rotary tool.

The longitudinal, vertical and transverse directions indicated in FIG. 2 are defined by the trihedron L, V, T. The transverse direction T is the direction perpendicular to the longitudinal direction of movement L of the flat substrate. The horizontal plane corresponds to the plane L, T. The front and rear positions are defined with respect to the transverse direction T as being on the operator's side and on the opposite operator's side, respectively.

DETAILED DESCRIPTION OF THE PREFERRED EMBODIMENTS

Figure 1:
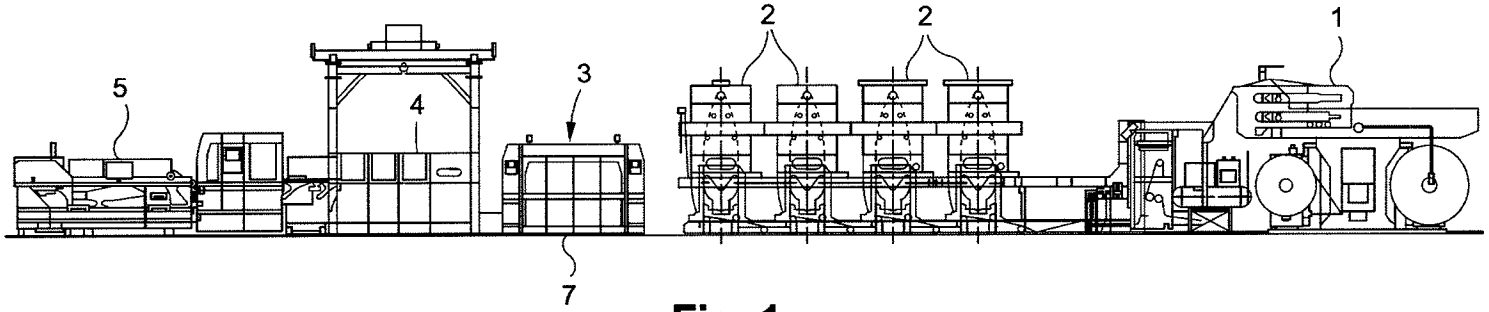
FIG. 1 is an overall view of an example of a conversion line for converting a flat substrate.

A conversion line for converting a flat substrate, such as flat cardboard or a continuous web of paper wound on a reel, makes it possible to carry out various operations and obtain packaging such as folding boxes. As shown in FIG. 1, the conversion line comprises, disposed one after another in the order of passage of the flat substrate, an unwinding station 1, several printer units 2, one or more embossing units in series followed by one or more scoring units in series 3, followed by a rotary cutting unit 4 or platen die-cutting unit, and a station 5 for receiving the manufactured objects.

The conversion unit 7 comprises an upper rotary tool 10 and a lower rotary tool 11 which modify the flat substrate by printing, embossing, scoring, cutting, ejection of scrap, etc., in order to obtain packaging.

The rotary tools 10 and 11 are mounted parallel to one another in the conversion unit 7, one above the other, and extend in the transverse direction T, which is also the direction of the axes of rotation A1 and A2 of the rotary tools 10 and 11 (see FIG. 2). The rear ends of the rotary tools 10 and 11, on the opposite operator's side, are driven in rotation by motorized drive means. In operation, the rotary tools 10 and 11 rotate in opposite directions about each of the axes of rotation A1 and A2 (arrows Fs and Fi). The flat substrate passes through the gap situated between the rotary tools 10 and 11 in order to be embossed and/or scored and/or cut and/or printed on therein.

At least one of the two rotary tools, the upper rotary tool 10 or the lower rotary tool 11, comprises a mandrel 12 and a removable sleeve 13 that is able to be fitted on the mandrel 12 in the transverse direction T (FIG. 2, arrow G). The sleeve 13 has a hollow and cylindrical overall shape. The mandrel 12 comprises a cylindrical core, a front end, and a rear end, which are situated on either side of the cylindrical core.

Thus, when changing the rotary tools 10 and 11 is desired, all that is necessary is to change the sleeves 13 rather than the entire rotary tool 10 and 11. Since it is easier to handle the sleeve 13 on account of its low weight relative to that of the entire rotary tool 10 and 11, the change of operation can be effected rapidly. Moreover, the sleeves 13 are inexpensive compared with the price of the rotary tool 10 and 11 as a whole. It is thus advantageous to use one and the same mandrel 12 in combination with several sleeves 13 rather than to acquire several entire rotary tools 10 and 11.

The conversion unit 7 comprises a front upper bearing 14, intended to support the front end of the upper rotary tool 10, and a front lower bearing 15, intended to support the front end of the lower rotary tool 11. The conversion unit 7 comprises a rear upper bearing 16, intended to support the rear end of the upper rotary tool 10, and a rear lower bearing 17, intended to support the rear end of the lower rotary tool 11. The upper and lower bearings 14, 15, 16 and 17 are aligned in pairs vertically one above the other.

The rear ends of the rotary tools 10 and 11, on the opposite operator's side, are driven in rotation by respective motorized drive means 18.

The conversion unit 7 comprises a tool-holder column 19 arranged at the front of the framework and a tool-holder column 20 arranged at the rear of the framework. The tool-holder columns 19 and 20 extend vertically. At least the body 9 of the tool-holder column 19 arranged at the front is in the form of a frame with a central passage 35.

The tool-holder columns 19 and 20 each comprise a front upper bearing 14 and a rear upper bearing 16 and a front lower bearing 15 and a rear lower bearing 17. The bearings 14, 15, 16 and 17 are movable vertically in opposite directions, on either side of the longitudinal direction L of movement of the flat substrate. The movements of the bearings 14, 15, 16 and 17 are shown by the double arrows Pa and Pr in FIG. 3.

The tool-holder column 19 and 20 can also be provided with a common drive for the bearings 14, 15, 16 and 17, allowing the bearings 14, 15, 16 and 17 to be moved simultaneously by one and the same distance in opposite directions. In other words, the upper and lower bearings 14, 15, 16 and 17 can be moved vertically in a symmetrical manner, simultaneously and at the same speed.

According to one exemplary embodiment, the common drive comprises a screw device 25. The bearings 14, 16 and 15, 17 are mounted one above the other in pairs on a screw device 25 of a respective tool-holder column 19 and 20, such that the rotation of the screw device 25 drives the linear movement of the bearings 14, 16 and 15, 17 in opposite vertical directions V.

The screw device 25 comprises at least one screw 26*a*, 26*b* extending in the vertical direction V and passing successively through the bearings 14, 16 and 15, 17 having an associated thread. The screw 26*a* and 26*b* comprises an upper helix engaging with the upper bearing 14 or 16, and a lower helix engaging with the lower bearing 15 or 17. The direction of the upper helix is the opposite of the direction of the lower helix, such that the rotation of the screw 26*a*, 26*b* drives the upper bearing 14 or 16 upward and the lower bearing 15 or 17 downward.

The screw devices 25 allow heavy loads such as those of the rotary tools 10 and 11 to be moved while affording effective setting precision of the movement and with good holding rigidity. Another advantage is that the screw devices 25 are robust and can hold the vertical positioning of the bearings 14, 15, 16 and 17 without deviation even under the effect of the vibrations that can arise in the framework of the conversion unit 7.

The screw 26*a*, 26*b* has, for example, a diameter of between 40 mm and 60 mm, for instance around 50 mm, and a screw pitch of between 0.5 mm and 2 mm, for instance around 1 mm. The screw 26*a*, 26*b* has for example a screw pitch, the manufacturing tolerance of which is less than about 10 μm. The diameter of the screw 26*a*, 26*b* can thus be large in relation to the screw pitch which is small, thereby making it possible to support heavy loads while having excellent setting precision of the movement.

Figure 6:
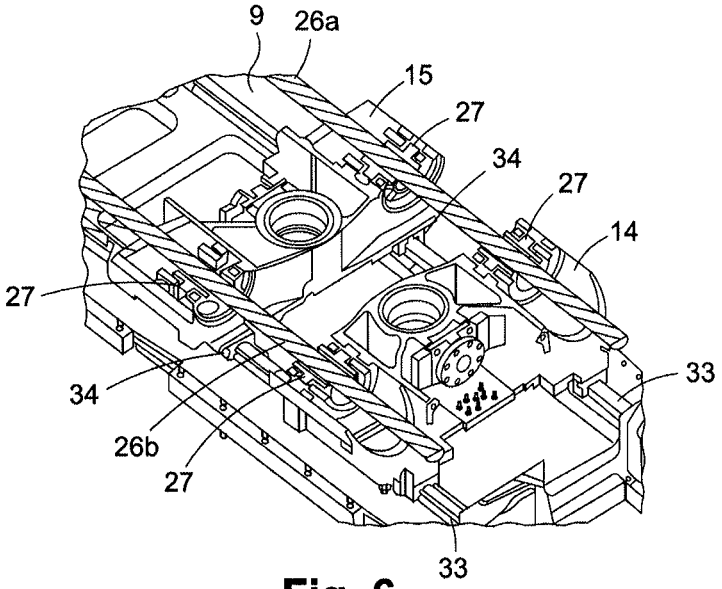
FIG. 6 shows a partial view in vertical cross section of the tool-holder column from FIG. 5.
Figure 7:
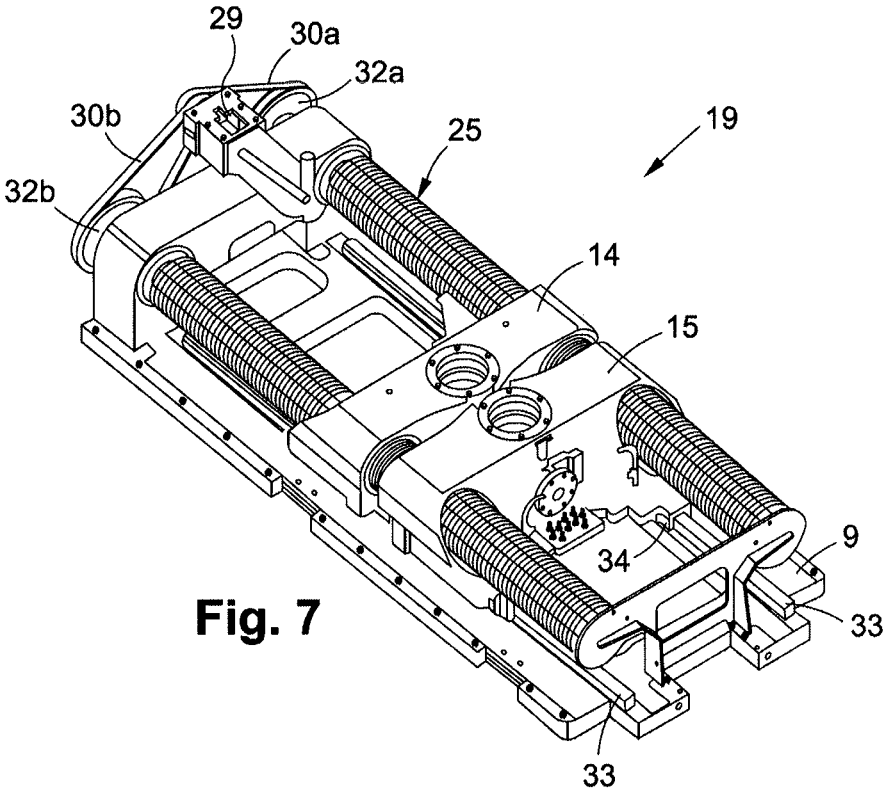
FIG. 7 is a view similar to FIG. 6, in perspective, with the upper and lower bearings in a moved-together position.
Figure 8:
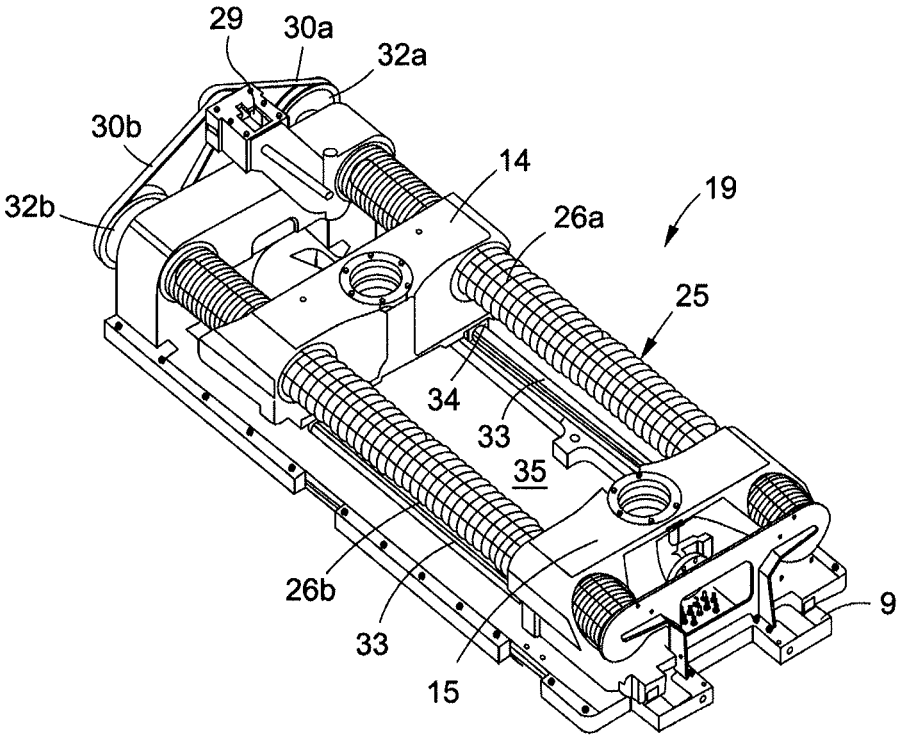
FIG. 8 shows a view similar to FIG. 7 with the upper and lower bearings in a spaced-apart maintenance position.

According to one exemplary embodiment, the screw 26*a*, 26*b* is a roller screw, also known as a satellite roller screw or planetary roller screw. The roller screws have nuts 27 which comprise rollers, arranged in a cylindrical ring of the respective bearing 14, 15, 16 and 17, around the screw 26*a*, 26*b*. The rollers of the nuts 27 ensure the rolling function (see FIG. 6). The large number of contact points allows the roller screws to support heavy loads and to ensure a high level of rigidity.

The screw device 25 comprises (visible in the exemplary embodiment in FIGS. 5, 6, 7 and 8) a first and a second screw 26*a*, 26*b* that are arranged parallel to one another, on each side of the upper and lower bearings 14, 15 or 16 and 17 passing through the bearings 14, 16 or 15, 17. The two screws 26*a* and 26*b* thus arranged ensure that the respective bearings 14, 16, 15, 17 are held in a balanced and reinforced manner.

According to one exemplary embodiment, the bearings 14, 16 or 15, 17 have substantially identical shapes, mounted facing one another. The bearings 14, 16 or 15, 17 each have, for example, overall shapes that are elongate in the longitudinal direction L of movement of the flat substrate. These embodiments of the bearings 14, 16, 15, 17 make it possible to concentrate the forces exerted by the respective tool-holder column 19, 20 at the bearings 14, 15, 16 and 17, ensuring good holding rigidity of the rotary tools 10 and 11.

According to one exemplary embodiment, the screw device 25 comprises a motorized device having a motor 29, the motor axis 31 of which is connected to the screws 26*a* and 26*b* such that they are driven simultaneously in rotation. The motorized device comprises, for example, a first and a second synchronous belt 30*a* and 30*b*. The first belt 30*a* is driven by the motor shaft 31 and drives a first pulley 32*a* mounted at the end of the first screw 26*a* of the screw device 25 in rotation. The first pulley 32*a* rotates as one with the first screw 26*a*. The second belt 30*b* is likewise driven by the motor shaft 31 and drives a second pulley 32*b* mounted at the end of the second screw 26*b* of the screw device 25 in rotation. The second pulley 32*b* rotates as one with the second screw 26*b*. Thus, the rotation of the motor shaft 31 drives the simultaneous rotation of the first and second screws 26*a* and 26*b* of the screw device 25 and thus the raising/lowering at the same speed of the two bearings 14, 15, 16 and 17. The motorized device ensures that the screws 26*a* and 26*b* rotate at the same speed such that the respective bearing 14, 15, 16 and 17 is not lowered/raised askew.

The bearings 14, 15, 16 and 17 and the body 9 of the tool-holder column 19 and 20 can also comprise complementary means for guiding in vertical translation V. More specifically (see FIG. 6), at least one vertical guide rail 33 is arranged, for example, along the body 9 of the tool-holder column 19 or 20. Correspondingly, the bearings 14, 15, 16 and 17 comprise a facing complementary vertical guide jaw 34 (or vice versa). For example, two vertical guide rails 34 can be arranged in parallel between the body 9 and the screw device 25, on each side of the upper and lower bearings 14, 15, 16 and 17.

Figure 3:
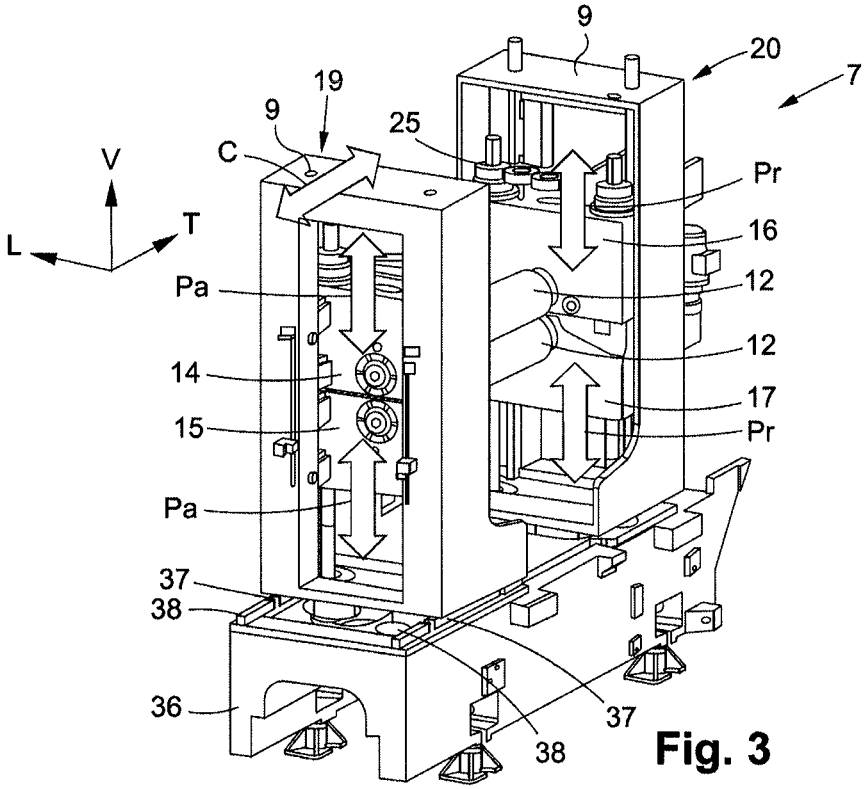
FIG. 3 shows a perspective side view of an exemplary embodiment of a conversion unit.
Figure 4:
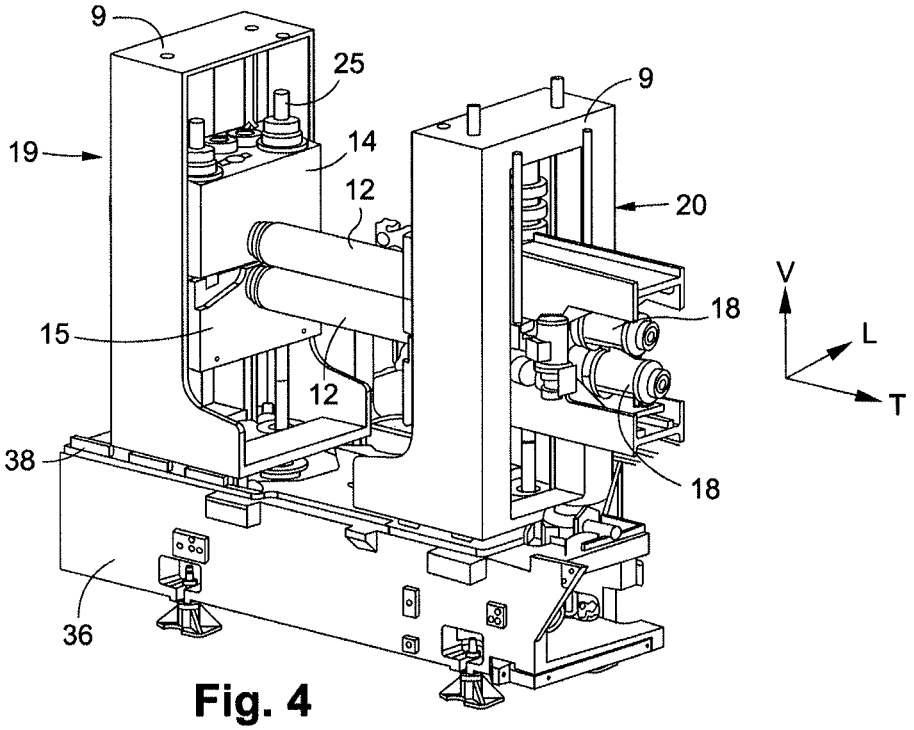
FIG. 4 is a figure similar to FIG. 3 after pivoting through about 90°.
Figure 5:
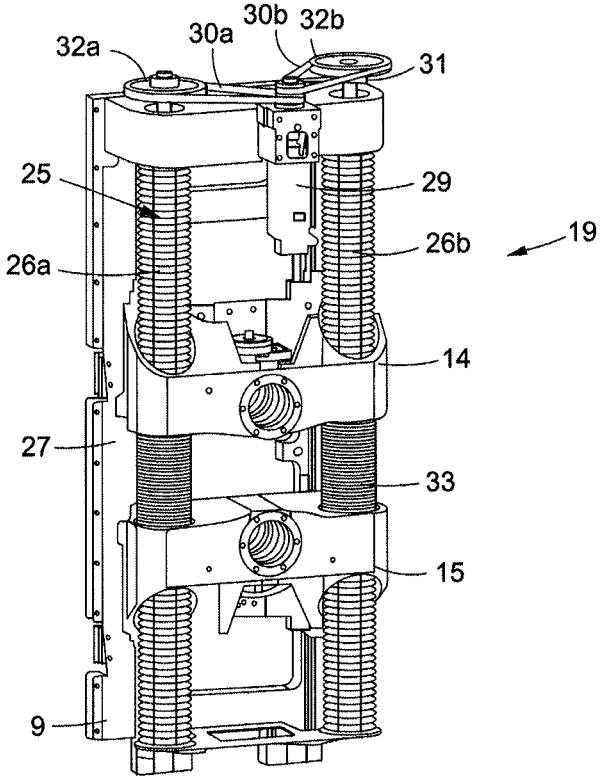
FIG. 5 shows an exemplary embodiment of a tool-holder column.

Moreover, one of the tool-holder columns 19 and 20 can be movable in translation in a direction parallel to the axis of the rotary tools 10 and 11 (arrows C in FIG. 3). That is, movable in transverse translation, between an operational position in which the upper and lower bearings 14, 15, 16 and 17 can engage with the ends of the upper rotary tool 10 and lower rotary tool 11 and a maintenance position in which the tool-holder column 19 is spaced apart from the operational position.

In the maintenance position, the upper and lower bearings 14, 15, 16 and 17 are positioned away from the ends of the rotary tools 10 and 11. The movable tool-holder column is, for example, the tool-holder column 19 arranged at the front of the framework of the conversion unit 7, on the operator's side, since it is not obstructed by the motorized drive means 18 for the rotary tools 10 and 11. The tool-holder column 20 arranged at the rear 36 of the framework is fixed.

The tool-holder column 19 and a pedestal 36 of the conversion unit 7 can comprise complementary means for guiding in transverse translation T. More specifically, the tool-holder column 19 has, for example, at least one transverse slide 37 facing a complementary transverse guide rail 38 that is arranged on the upper part of the pedestal 36 and extends in the transverse direction T (or vice versa). For example, two transverse guide rails 38 can be arranged in parallel under the tool-holder column 19 arranged at the front.

At least one of the bearings 14, 15, 16 and 17 is movable out of the central passage 35 of the tool-holder column 19, allowing the extraction or insertion of at least one rotary tool 10 and 11.

The transverse mobility of the tool-holder column 19 makes it possible to disengage the ends of the rotary tools 10 and 11 from their respective bearings 14 and 15 such that the latter can then be offset vertically from one another to free up a central passage 35 allowing access to the rotary tools 10 and 11. Thus, the front upper or lower bearings 14 and 15 can be movable between a moved-together position (see FIG. 7), for example, when the conversion unit 7 is at rest and does not have rotary tools 10 and 11, or only the mandrels 12, and a maintenance position or during a change of operation, in which the two front upper and lower bearings 14, 15 are spaced apart from one another, leaving free a central passage 35 allowing the extraction or insertion of complete rotary tools 10 and 11, sleeves 13 or mandrels 12 (see FIG. 8).

The conversion unit 7 comprises, for example, a processing unit configured to independently control both the vertical movement of the bearing support carriages 14 and 16 of the tool-holder column 19 arranged at the front, and the vertical movement of the bearings 15 and 17 of the tool-holder column 20 arranged at the rear.

In the initial operational position of the conversion unit 7 (FIG. 9), the upper and lower bearings 14, 15, 16 and 17 engage with the ends of the upper and lower rotary tools 10 and 11.

Figure 9:
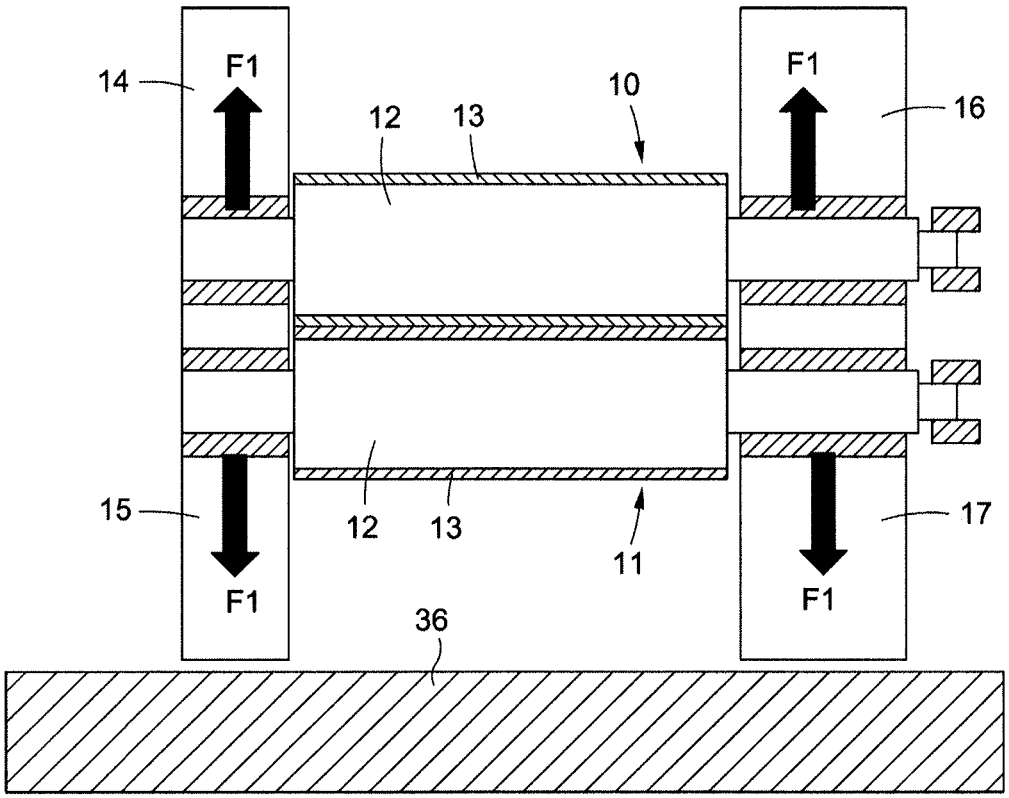
FIG. 9 shows a schematic view of a conversion unit in the operational position.

When changing a rotary tool 10 and 11, a sleeve 13 or a mandrel 12 is desired, the operator may start by spacing the bearings 14, 15, 16 and 17 slightly apart vertically in opposite directions, thus ensuring that the rotary tools 10 and 11 are not in contact during the tool change (arrows F1 in FIG. 9).

Figure 10:
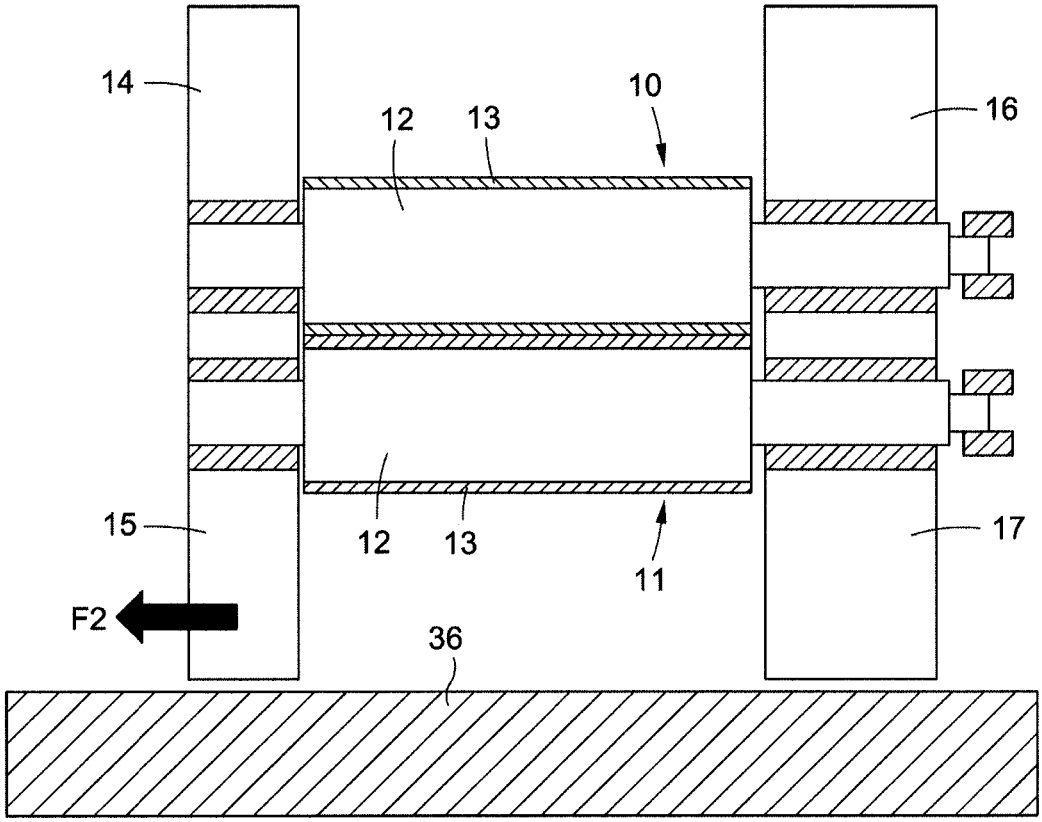
FIG. 10 shows a view similar to FIG. 9 in the maintenance position.

Next, the operator may transversely offset the tool-holder column 19 arranged at the front into a maintenance position (arrow F2 in FIG. 10). In this spaced-apart position of the operational position, the upper and lower bearings 14 and 15 are disengaged from the ends of the rotary tools 10 and 11.

Figure 11:
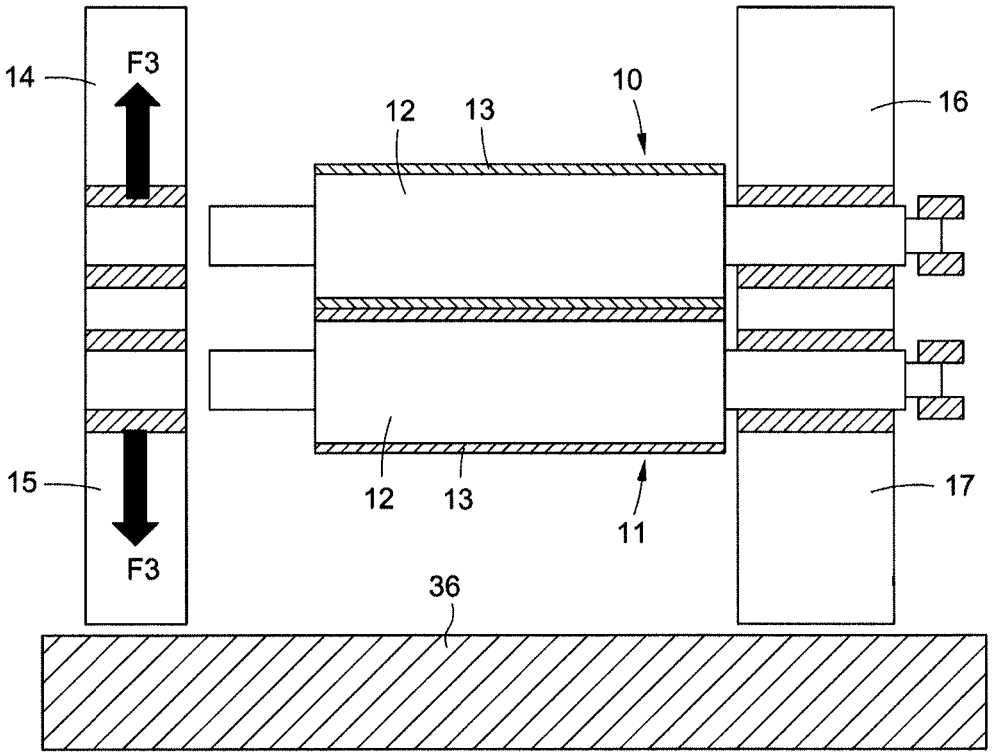
FIG. 11 shows a step following the step in FIG. 10.

Next, the operator may space apart the bearings 14 and 16 of the tool-holder column 19 arranged at the front, vertically in opposite directions, with a large amplitude, positioned out of a central passage 35 to allow the extraction of the rotary tools 10 and 11 (arrows F3 in FIG. 11).

Figure 12:
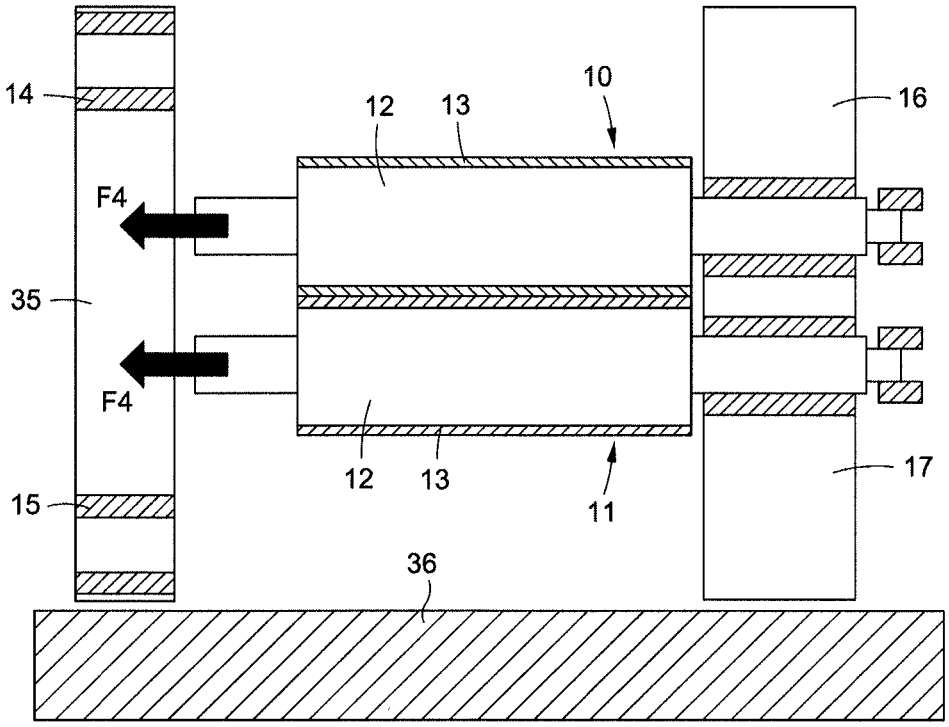
FIG. 12 shows a step following the step in FIG. 11.

The operator can then access the rotary tools 10 and 11 and change a rotary tool 10 and 11, a sleeve 13 or a mandrel 12 (arrows F4 in FIG. 12).

Next, the operator may vertically move the bearings 14 and 16 of the tool-holder column 19 arranged at the front toward one another.

The operator may then transversely offset the tool-holder column 19 arranged at the front to engage the ends of the rotary tools 10 and 11 in the upper and lower bearings 14 and 15.

The mounting and removal of the rotary tools 10 and 11 are thus rendered easier. The vertical movability of the bearings 14, 15, 16 and 17 makes it possible to adjust the spacing between the rotary tools 10 and 11 notably in order to set the radial gap between the tools 10 and 11, either during production or during a downtime, while maintaining rigidity. The vertical movability of the bearings also makes it possible to offset the bearings 14, 15, 16 and 17 from one another in a maintenance phase, once the bearings 14, 15, 16 and 17 have been disengaged from the rotary tools 10 and 11 to free up a central passage 35 allowing access to the rotary tools 10 and 11.

Moreover, this makes it possible to move the rotary tools 10 and 11 by way of drives that have effective setting precision of the movement and holding rigidity, which are significant constraints to be respected in order to carry out the conversion operations properly.

The present invention is not limited to the embodiments described and illustrated. Numerous modifications can be made without otherwise departing from the scope defined by the set of claims.

The invention claimed is:

1. A conversion unit configured to convert a flat cardboard substrate, the conversion unit comprising a pair of tool-holder columns and a pedestal configured to support the pair of tool-holder columns, the pair of the tool-holder columns comprising:

a first tool-holder column and a second tool-holder column;

an upper rotary tool and a lower rotary tool, the upper and lower rotary tools configured to convert the flat cardboard substrate;

two upper bearings, each of the upper bearings configured to support one end of the upper rotary tool, and two lower bearings, each of the lower bearings positioned to support one end of the lower rotary tool, the flat substrate being movable longitudinally along a longitudinal path between the upper rotary tool and the lower rotary tool, wherein the two upper bearings move in a vertical direction opposite to a vertical movement of the two lower bearings, the movement of the two upper bearings away from the two lower bearings creating vertical space between the two upper bearings and the two lower bearings;

a common drive for the two upper bearings and the two lower bearings, the common drive configured to facilitate the vertical movement of the two upper bearings and the two lower bearings simultaneously by one and the same distance in the opposite directions, and the common drive comprising:

a screw device, the two upper bearings being mounted above the two lower bearings on the screw device such that rotation of the screw device causes a linear movement of the two upper bearings and the two lower bearings in the opposite directions, wherein the screw device comprises:

a first screw positioned at a first upper bearing of the two upper bearings and at a first lower bearing of the two lower bearings, and a second screw positioned at a second upper bearing of the two upper bearings and at a second lower bearing of the two lower bearings, and arranged parallel to the first screw; and the first tool-holder column further comprising a transverse slide with a length in a first direction parallel to axes of the upper and lower rotary tools; and the pedestal comprising a transverse guide rail with a length in the first direction and configured to cooperate with the transverse slide of the first tool-holder column such that the first tool-holder column is moved in the first direction with respect to the second tool-holder column between;

an operational position in which the two upper bearings and the two lower bearings engage with the ends of the upper and lower rotary tools, and a maintenance position in which the first tool-holder column is spaced apart from the operational position, and in the maintenance position one of the upper bearings and one of the lower bearings positioned at the first tool-holder column is free from engagement with the ends of the upper and lower rotary tools.

2. The conversion unit according to claim 1, wherein the screw device comprises at least one screw that extends in the vertical direction and comprises:

an upper helix engaging with the bearing in which the upper bearings are provided, and a lower helix engaging with the bearing in which the lower bearings are provided, wherein the direction of the upper helix is opposite to the direction of the lower helix.

3. The conversion unit according to claim 1, wherein the screw device comprises at least one roller screw.

4. The conversion unit according to claim 1, wherein the screw device comprises a motorized device that is configured to drive the first and the second screws simultaneously in rotation.

5. The conversion unit according to claim 4, wherein the motorized device comprises:

a first and a second belt, wherein the first belt being is driven in rotation by a motor shaft of the motorized device and driving a first pulley mounted at the end of the first screw of the screw device in rotation, and wherein the second belt being is driven in rotation by the motor shaft and driving a second pulley mounted at the end of the second screw of the screw device in rotation.

6. The conversion unit according to claim 1, wherein the two upper bearings and the two lower bearings and a body of the tool-holder column comprise complementary guides configured to guide in vertical translation.

7. The conversion unit according to claim 1, wherein at least one of the two upper bearings and the two lower bearings is movable out of a central passage, allowing the extraction or insertion of at least one rotary tool.

8. The conversion unit according to claim 1, wherein the first tool-holder column is arranged at an operator's side.

9. The conversion unit according to claim 1, further comprising a processing unit configured to independently control both the vertical movement of the front upper bearing and the front lower bearing of the first tool-holder column arranged at the operator's side, and the vertical movement of the rear upper bearing and the rear lower bearing of the second a tool-holder column arranged at a side opposite the operator's side.

10. The conversion unit of claim 1, wherein the common drive further comprises:

a third screw parallel to the first screw, and positioned at a side of the first upper bearing and the first lower bearing opposite the first screw; and a fourth screw parallel to the second screw, and positioned at a side of the second upper bearing and the second lower bearing opposite the second screw.

11. A method for removing at least one rotary tool from a conversion unit according to claim 1, the method comprising:

vertically moving the two upper bearings and the two lower bearings in opposite directions, offsetting the first tool-holder column arranged at the front such that the front upper bearing and the front lower bearing are disengaged from the ends of the rotary tools; and then moving the front upper bearing and the front lower bearing of the first tool-holder column vertically in opposite directions such that the front upper bearing and the front lower bearing are positioned out of a central passage, allowing the extraction of the rotary tools.

12. A method for mounting at least one rotary tool in the conversion unit according to claim 1, the method comprising:

moving the front upper bearing and the front lower bearing of the first tool-holder column vertically toward one another, and then offsetting the first tool-holder column such that the ends of the rotary tools engage in the front bearing.

* * * * *